US006814272B2

(12) United States Patent
Storti

(10) Patent No.: US 6,814,272 B2
(45) Date of Patent: Nov. 9, 2004

(54) NAILING MACHINE

(75) Inventor: Giancarlo Storti, Cremona (IT)

(73) Assignee: Stori S.p.A., Cremona (IT)

( * ) Notice: Subject to any disclaimer, the term of this patent is extended or adjusted under 35 U.S.C. 154(b) by 0 days.

(21) Appl. No.: 10/429,008

(22) Filed: May 2, 2003

(65) Prior Publication Data

US 2003/0205606 A1 Nov. 6, 2003

(30) Foreign Application Priority Data

May 3, 2002 (IT) ..... MI2002A0942

(51) Int. Cl.[7] ..... B27F 7/02

(52) U.S. Cl. ..... 227/100; 227/7; 227/40; 227/99

(58) Field of Search ..... 227/7, 40, 45, 227/99, 100, 111, 148, 151, 152, 153, 154; 29/430

(56) References Cited

U.S. PATENT DOCUMENTS

| | | | | | |
|---|---|---|---|---|---|
| 3,512,242 | A | * | 5/1970 | Harvis | 29/252 |
| 3,733,020 | A | * | 5/1973 | Ingram | 227/5 |
| 4,093,111 | A | * | 6/1978 | Katoh | 227/26 |
| 4,793,540 | A | * | 12/1988 | Mangan et al. | 227/7 |
| 4,824,004 | A | * | 4/1989 | Hanson | 227/152 |
| 5,058,795 | A | * | 10/1991 | Tonus | 227/7 |
| 6,164,512 | A | * | 12/2000 | Raffoni | 227/152 |

* cited by examiner

*Primary Examiner*—Stephen F. Gerrity
*Assistant Examiner*—Nathaniel Chukwurah
(74) *Attorney, Agent, or Firm*—Kirschstein, et al.

(57) ABSTRACT

A nailing machine for pallets, comprises nailing grippers supported by a beam which is controllably movable in a vertical plane and includes feeding bins for feeding nails to the grippers, with a plurality of gripper holding beams movable in a vertical plane, a central gripper holding beam being supported by a locally fixed construction, adjoining gripper holding beams being adapted to be properly positioned with respect to the workpiece to be nailed.

6 Claims, 4 Drawing Sheets

NAILING MACHINE

BACKGROUND OF THE INVENTION

The present invention relates to a nailing machine.

As it is known, for making different articles of manufacture, constituted by wood elements, nailing machines, provided for firmly coupling wood pieces such as battens, blocks or strips, to provide a finished product are conventionally used.

One of the above mentioned articles, usually made on an industrial scale, comprises the so-called shipment and storing pallets, including a plurality of parallel wood battens, so arranged as to form a bearing surface for goods being transported.

The parallel battens bear on cross strips which, in turn, bear on small wood blocks.

Usually, in standardized pallets, said wood blocks are arranged along three geometrical axes, with a mutually parallel relationship.

For making a pallet of the above disclosed configuration, modern nailing lines, as known from the prior art, provide to use a nailing machine which, at a first operating step, nails the constructional elements arranged at a first block or cross member row and which, in a following operating step, clamps the elements arranged at a second block row and then, after a further feeding of the pallet, nails the wood strips of a third block row.

Since, in a prior nailing machine, a nailing operation requires an average operating time of about seconds, it would be apparent that for carrying out, by a prior nailing machine, the above mentioned three nailing steps to provide a standard pallet, about 15 seconds would be required, and, accordingly, the production yield of such a prior nailing machine would approximately correspond to 240 pallets/hour.

Considering that pallet manufacturers require nailing machines with ever-increasing power and speed capabilities, and further considering that for technical reasons the reciprocating times of the nailing gripper supporting ram cannot be further shortened, manufacturers have for quite some time tried to overcome these productive/technological limits however without achieving the desired goals.

SUMMARY OF THE INVENTION

Accordingly, the aim of the present invention is to overcome the above mentioned drawbacks of the prior art, by providing a nailing machine adapted to drastically reduce the nailing time for making a pallet or a like article of manufacture, which machine, by a single operating stroke, provides a plurality of parallel nailing rows.

According to one aspect of the invention, the above aim is achieved by a nailing machine comprising nailing grippers supported by a supporting beam which is controllably movable in a vertical plane and includes nail feeding bins for feeding nails to said grippers, characterized in that said machine further comprises a plurality of gripper holding beams movable in a vertical plane, that the central gripper holding beam is supported by a locally fixed supporting construction and that adjoining gripper holding beams are supported by supports which can be operatively positioned with respect to a workpiece to be nailed.

By a nailing machine having the above features, it is possible to precisely arrange the workpiece to be nailed under the nailing grippers mounted on a first beam supported by a supporting construction which is locally fixed with respect to the framework of the nailing machine, whereas the front gripper holding beam construction can be precisely arranged at the block or cross-member row arranged at a front end portion of the pallet, the remaining nailing beam construction being adapted to be arranged at the series of blocks provided at the rear end portion of the pallet.

Owing to the provision of a plurality of simultaneously driven hydraulic cylinders, the nailing gripper supporting beams can be simultaneously driven, thereby allowing to make, for example, a standardized pallet with a single operating stroke of all the gripper holding beams, so as to reduce the nailing time per pallet to about 5 seconds.

BRIEF DESCRIPTION OF THE DRAWINGS

The subject matter according to the present invention will be hereinafter disclosed in a more detailed manner, with respect to an embodiment thereof, given only by way of an example and shown in the accompanying drawings, where.

DESCRIPTION OF THE PREFERRED EMBODIMENT

Figure 1:
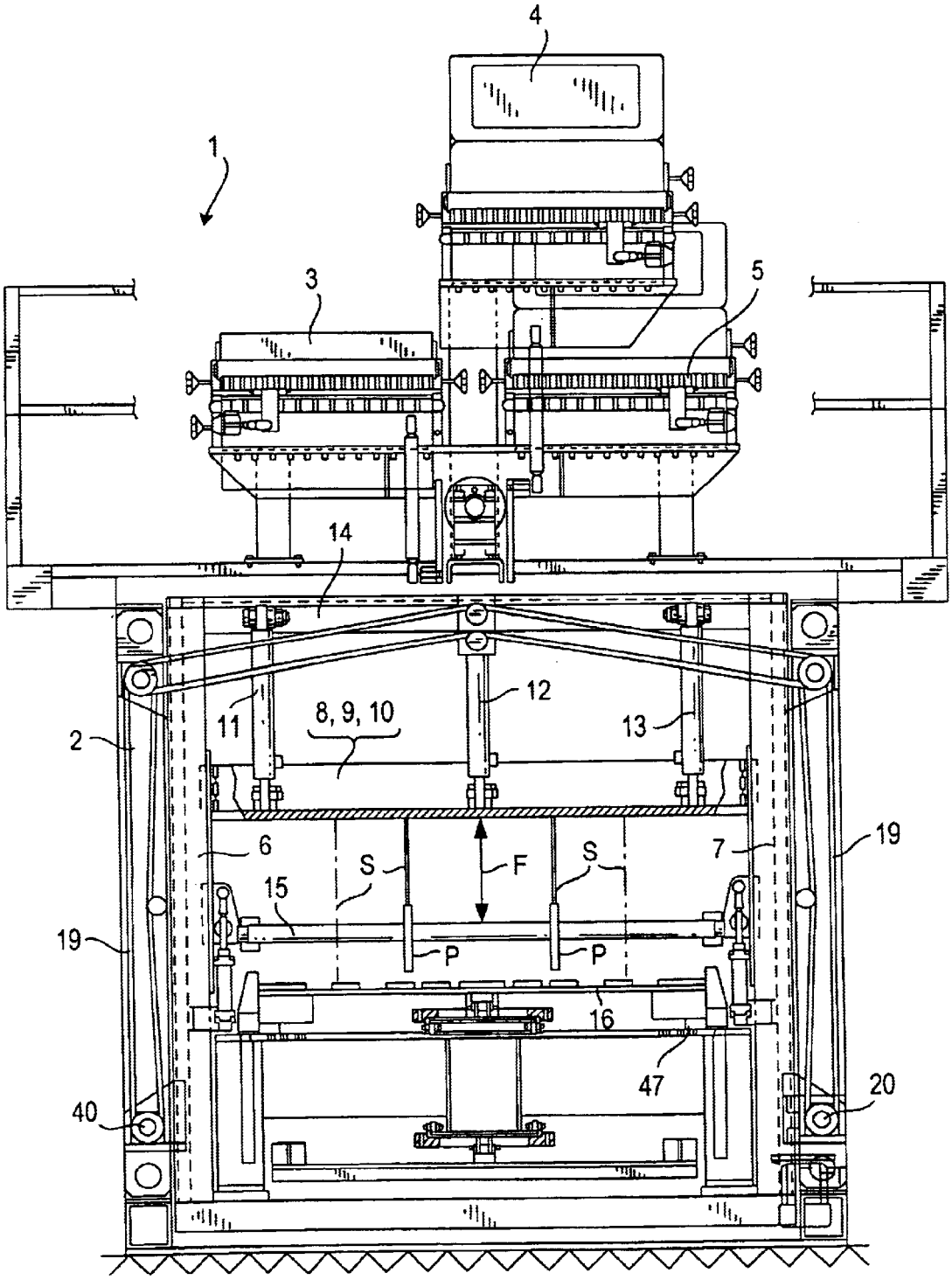
FIG. 1 is a front view illustrating the nailing machine according to the invention.

As shown in FIG. 1, the inventive nailing machine, generally indicated by the reference number 1, comprises a strong framework 2, supporting known swinging bins 3, 4 and 5 holding therein the nails to be used.

On a side thereof, the framework 2 comprises parallel guides 6, 7 supporting cross beams 8, 9 and 10. Each beam 8, 9 and 10 is articulately coupled with the piston rods of a plurality of hydraulic cylinders, indicated by 11, 12 and 13.

The top end portions of the hydraulic cylinders 11, 12, 13 of each beam 8, 9, and 10 are in turn articulately coupled to a corresponding top cross member 14 of the framework 2 of the nailing machine 1.

Each beam 8, 9 and 10 can be upward and downward driven by said cylinders 11, 12 and 13 as is shown in FIG. 1 by the arrow f.

In a per se known manner, each beam 8, 9 and 10 operatively supports stem elements S cooperating with tubular grippers P, in turn supported by a cross member 15 above the pallet 16 bearing on a conveyor belt of a nailing plane, schematically indicated by 47.

As the beams 8, 9, 10 are downward driven, the stem elements S will enter the grippers P which can be freely horizontally arranged with respect to the body of the underlying pallet 16, to drive nails into the pallet 16 constructional elements.

Figure 2:
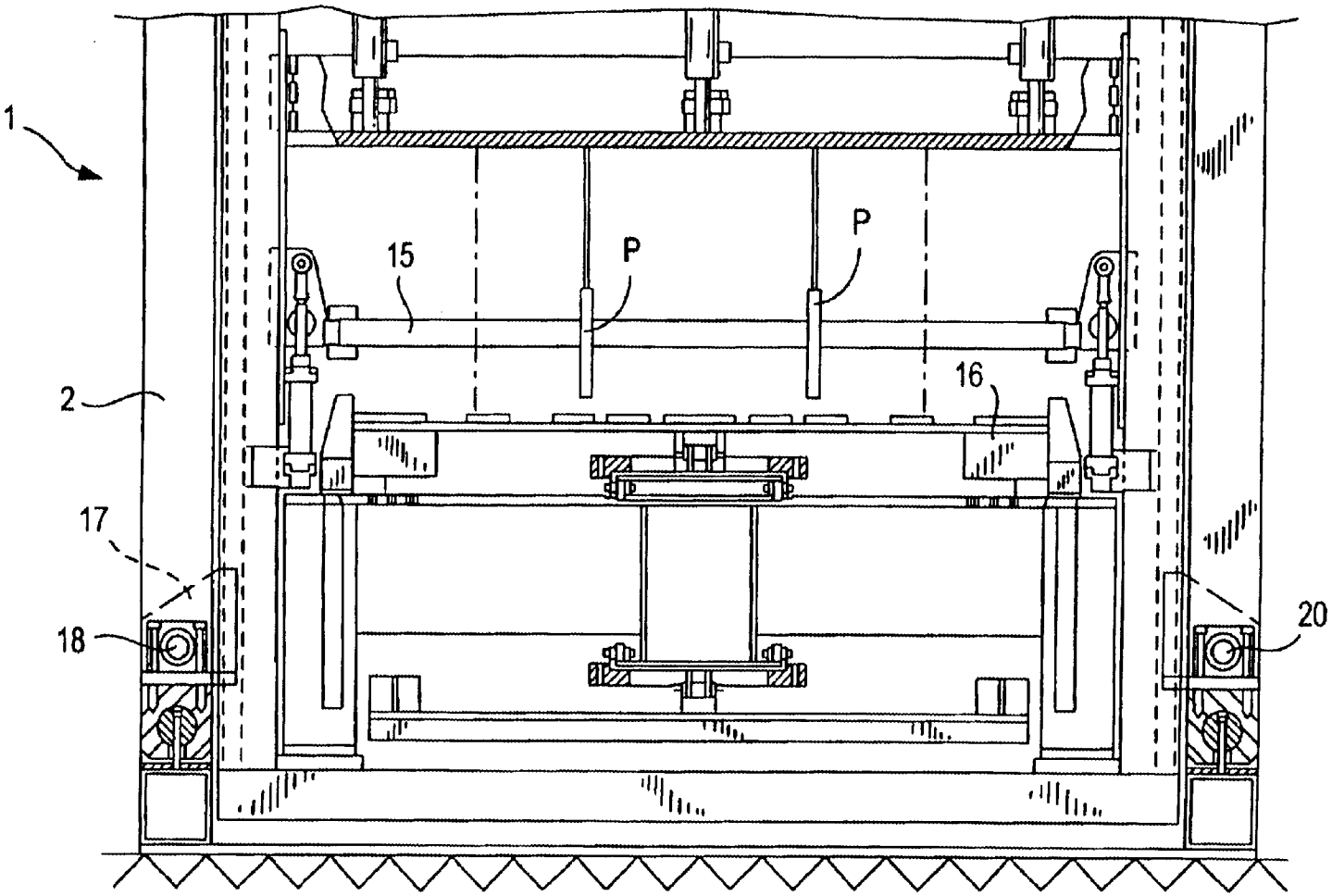
FIG. 2 is a further front view illustrating a detail of a nailing machine, the nailing grippers and a pallet being shown in a schematic manner.

FIG. 2 schematically shows the cross member 15 and related grippers P. In particular, said grippers P are so arranged along the cross member 15, as to allow the pallet 16 elements to be nailed at any desired nailing points.

On the bottom of the framework 2 of the nailing machine, generally indicated by 1, a controlled motor 17 which drives a driving shaft 18 entraining, through belts or chains 19, a further shaft 20 arranged on the opposite side of the framework 2 is provided.

The functions of the above constructional elements will be disclosed in a more detailed manner hereinafter.

Figure 3:
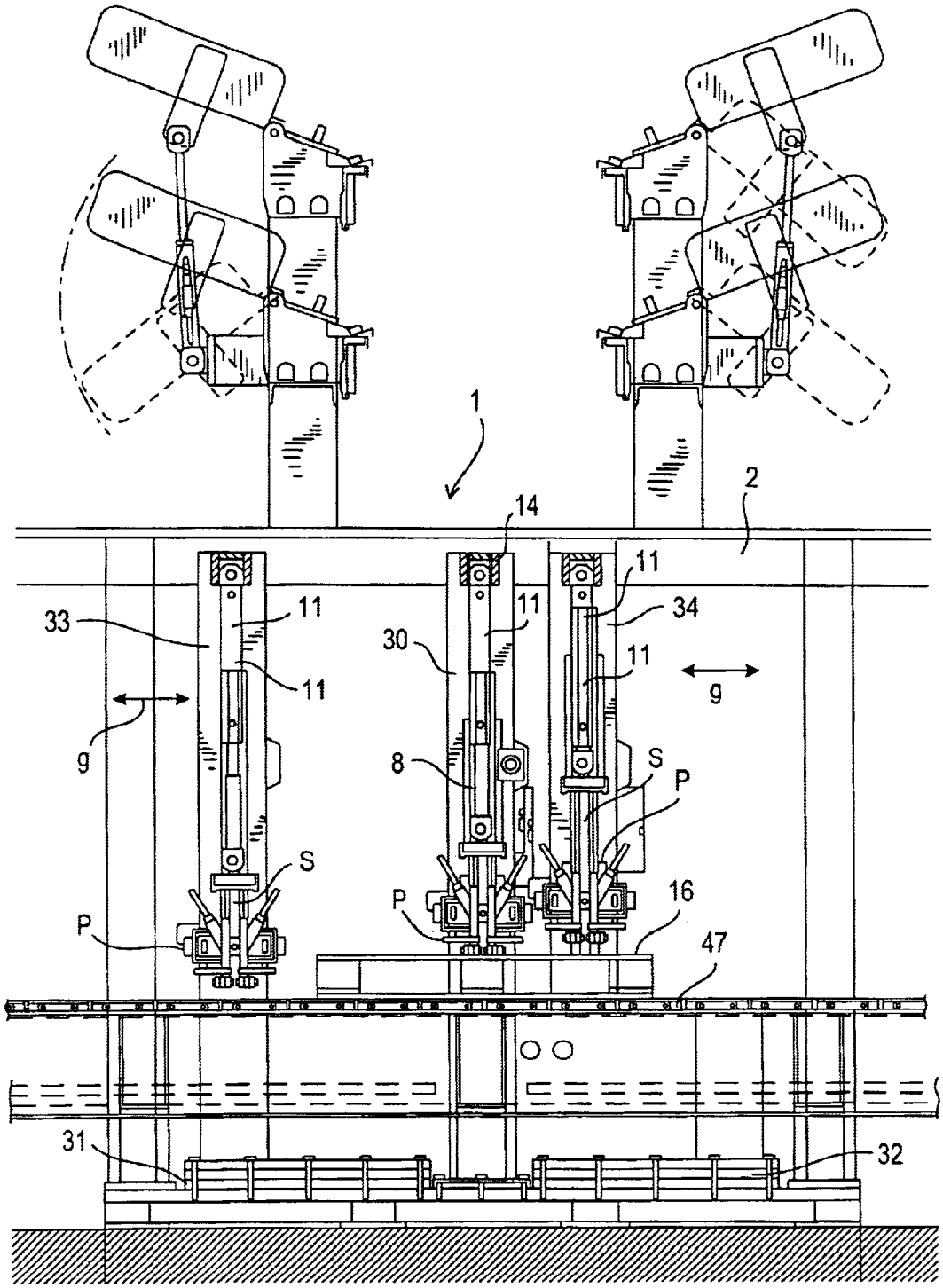
FIG. 3 is a side elevation view of the nailing machine.

FIG. 3 is a side view of the nailing machine and related framework 2. As shown, said framework 2 supports a plurality of nail bins 3, 4 and 5, storing therein nail elements, which are per se known.

At the center of the framework 2, on both side of the nailing machine, an upright 30 is provided, said upright being locally fixed with respect to the framework 2 of the nailing machine 1.

A cross member 14 (coupled to said uprights) supports said hydraulic cylinders 11, 12 and 13 the piston rods of which affect the underlying beam 8, 9, 10, including the mentioned stem elements which, in turn, affect said grippers P for driving the nail elements into the underlying block of the pallet 16.

At the bottom portion of the framework 2, near the floor, said framework 2 supports mechanical guides 31 and 32, which in turn slidingly support, as indicated by the arrows g, further uprights 33 and 34.

Thus, owing to the provision of the movable uprights 33 and 34, the grippers P supported thereby can be properly arranged with respect to the body of the pallet 16.

As stated, each gripper P engages therewith a known movable stem element S. Moreover, the stem elements S of the uprights 33 and 34 can also be driven by the plurality of pistons generally indicated by 11.

Figure 4:
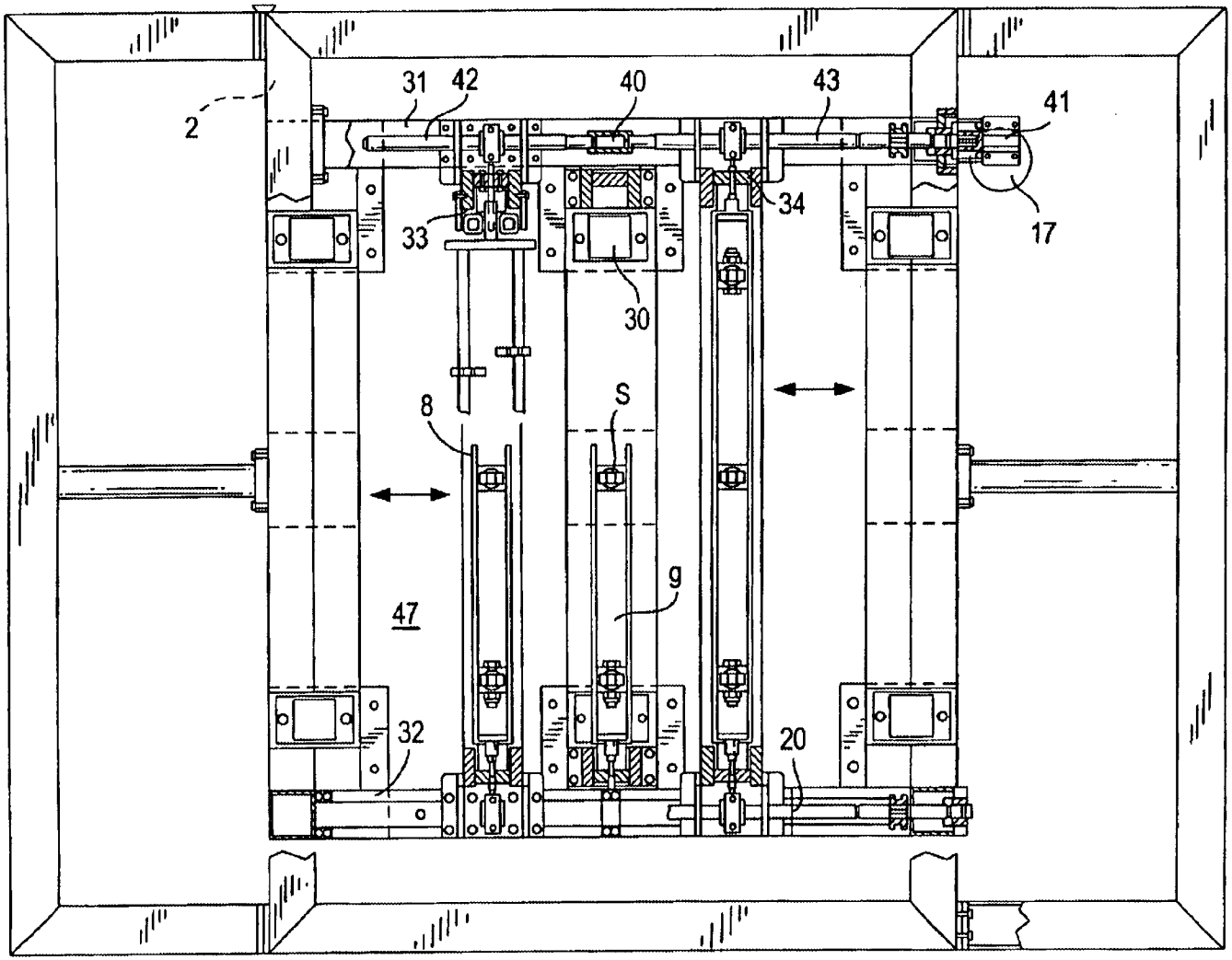
FIG. 4 is a schematic top plan view illustrating the main parts of the nailing machine.

FIG. 4 shows the locally fixed position of the upright 30, on which the central beam 9 is upward and downward movably supported, said central beam 9 affecting, by the stem elements S thereof, said nailing gripper P.

The upright 30 cooperates with a further upright 33 supporting a beam 8 and on the opposite side of said upright 30, which is locally fixed, a further upright 34, also including a movable beam is also provided.

Thus, each beam 33, respectively 34, can be driven in horizontal precision guides 31, 32.

To allow the movable uprights 33 and 34 to be automatically arranged with respect to the fixed central upright 30, near the upright 30 a threaded driving shaft, generally indicated by 40 is provided.

Said shaft is coupled to geared unit 41, in turn driven by a controllable motor 17. The shaft 40 comprises a rightward threaded portion 42 and a leftward threaded portion 43.

The threaded portion 42 is operatively coupled to the upright 33, whereas the threaded portion 43 is operatively coupled to the upright 34.

As is further shown in FIG. 4, the opposite parts of the uprights 33, 34 are also operatively coupled to a driving shaft 20, identical to the shaft 40 and, by driving chains or belts 19, the driving torque transmitted by the motor 17 to the shaft 18 will be also transmitted to the shaft 20, thereby perfectly driving said uprights 33 and 34.

Advantageously, on the top portion of the framework 2 precision guides and screws for driving the uprights 33, 34 are also provided.

The nailing machine 1 operates as follows:

Depending on the nailing points at which the pallet 16 must be nailed at the nailing position provided on the plane 47 of the machine, the positions of the grippers P and stem elements S of each beam 8, 9, 10 are at first adjusted.

Such an adjustment of the grippers P and stem elements S can also be automatically performed, by controllably driving the pin or stem elements S and grippers P with respect to the corresponding beams 8, 9, 10 by operatively coupling the grippers P of each cross-member 15, for example, to locating screws connected to controllable motors.

After having adjusted said grippers P and stem elements S, the upright 33 and upright 34 are properly arranged with respect to the workpiece 16 to be nailed and with respect to the locally fixed upright 30.

After having performed this further adjustment operation, is determined the precise nailing position of the pallet 16 supplied, for example, by a controllable conveyor belt or chain, lying in the plane 47.

With the workpiece 16 arranged at the desired nailing position, all the hydraulic cylinders 11, 12, 13 are simultaneously supplied with pressurized hydraulic fluid, thereby all the cross beams 8, 9, 10 will be simultaneously lowered toward the workpiece 16, so as to actuate the stem elements S, which are simultaneously engaged in the grippers P already supplied with the nails to be used. Thus, by a single lowering stroke, the stem elements S will simultaneously introduce or drive the nails into the constructional elements forming the pallet 16 to be assembled. More specifically, owning to the provision of the multiple nailing assemblies 8, 9, 10 which can be properly arranged in the inventive nailing machine 1, it is possible to make a pallet by nailing a plurality of nailing points thereof with a single nailing operating stroke, thereby drastically reducing the pallet making time.

Owing to the above disclosed embodiment of the nailing machine 1, comprising a central nailing assembly 9 which is arranged locally fixed and two further nailing assemblies 8, 10 which can be precisely driven and arranged at a desired nailing point, and owing to the provision of precision screws which can be actuated by a controllable motor, the movable nailing assemblies 8, 10 can be properly located in a very reduced time, thereby further drastically reducing the pallet making time, while allowing the nailing machine to be quickly fitted to different pallet sizes to be made.

What is claimed is:

1. A machine for nailing multiple elements of a workpiece, comprising:

a) a frame;

b) a central supporting beam and a pair of side supporting beams, the beams being mounted on the frame above the workpiece and spaced apart along a horizontal direction, the side beams being movable toward and away from the central beam along the horizontal direction;

c) a plurality of nail grippers mounted on each beam and facing the workpiece;

d) a drive for moving the side beams to selected positions relative to the central beam; and e) hydraulic units operatively connected to all the beams, and operative for simultaneously moving the central beam and the side beams in their selected positions, as well as the nail grippers on the beams, from a raised position in which nails are held by the grippers, to a lowered position in which the nails are driven into the workpiece elements, along a vertical direction perpendicular to the horizontal direction.

2. The machine of claim 1, wherein the hydraulic units are hydraulic cylinders, and wherein a plurality of hydraulic cylinders is connected to each beam.

3. The machine of claim 1, wherein the drive includes an electric motor and a drive train connected to both side beams.

4. The machine of claim 3, wherein the drive train includes a pair of drive shafts having opposite threads.

5. The machine of claim 1, wherein the frame includes a pair of parallel guides for guiding the side beams during movement along the horizontal direction.

6. The machine of claim 1, and a conveyor for conveying the workpiece underneath the beams.

* * * * *

UNITED STATES PATENT AND TRADEMARK OFFICE

CERTIFICATE OF CORRECTION

PATENT NO. : 6,814,272 B2
DATED : November 9, 2004
INVENTOR(S) : Storti

It is certified that error appears in the above-identified patent and that said Letters Patent is hereby corrected as shown below:

Title page,
Item [73], Assignee, replace "Stori" with -- Storti --.

Signed and Sealed this

Seventeenth Day of May, 2005

JON W. DUDAS
*Director of the United States Patent and Trademark Office*